US009833995B2

(12) United States Patent
Morisue

(10) Patent No.: US 9,833,995 B2
(45) Date of Patent: Dec. 5, 2017

(54) LIQUID EJECTION HEAD AND LIQUID EJECTION APPARATUS

(71) Applicant: CANON KABUSHIKI KAISHA, Tokyo (JP)

(72) Inventor: Masafumi Morisue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/227,387

(22) Filed: Aug. 3, 2016

(65) Prior Publication Data

US 2017/0043579 A1 Feb. 16, 2017

(30) Foreign Application Priority Data

Aug. 11, 2015 (JP) ..... 2015-159000

(51) Int. Cl.
*B41J 2/14* (2006.01)

(52) U.S. Cl.
CPC .... *B41J 2/1433* (2013.01); *B41J 2002/14411* (2013.01); *B41J 2202/11* (2013.01)

(58) Field of Classification Search
CPC ..... B41J 2/1433; B41J 2/14201
See application file for complete search history.

(56) References Cited

U.S. PATENT DOCUMENTS

2014/0285577 A1* 9/2014 Nagaoka ..... B41J 2/1631 347/47

FOREIGN PATENT DOCUMENTS

JP 2007-331245 A 12/2007

* cited by examiner

*Primary Examiner* — Jason Uhlenhake
(74) *Attorney, Agent, or Firm* — Fitzpatrick, Cella, Harper & Scinto

(57) ABSTRACT

A liquid ejection head and a liquid ejection apparatus are provided by which the variation of the droplet ejection amount can be suppressed and the occurrence of the unevenness can be suppressed. To realize this, grooves sandwiching an ejection port and a liquid chamber are provided.

18 Claims, 11 Drawing Sheets

LIQUID EJECTION HEAD AND LIQUID EJECTION APPARATUS

BACKGROUND OF THE INVENTION

Field of the Invention

The present invention relates to a liquid ejection head for ejecting liquid and a liquid ejection apparatus including the liquid ejection head.

Description of the Related Art

Examples using a liquid ejection head for ejecting liquid include an inkjet-type liquid ejection apparatus. A liquid ejection head provided in a general inkjet-type liquid ejection apparatus includes a flow path, an ejection energy generation unit provided in a part of the flow path, and a minute ejection port for ejecting liquid by the energy generated therein.

Liquid ejection apparatuses in recent years have been required to provide a higher speed, a higher image quality, and a higher definition. It has been intended to provide ejected droplets providing smaller dots and droplets ejected through ejection ports having more uniform volumes.

Japanese Patent Laid-Open No. 2007-331245 discloses that a slit is provided in a member forming an ejection port to improve the reliability of a liquid ejection head including many ejection ports that can realize a higher speed.

SUMMARY OF THE INVENTION

The liquid ejection head of the present invention has an ejection port forming member forming at least two or more ejection ports. A liquid chamber communicating with the ejection ports is formed so as to correspond to the ejection ports. In the liquid ejection head for ejecting liquid through the ejection ports, the ejection port forming member has grooves so as to sandwich the ejection ports and the liquid chamber. A part of the ejection port forming member forming the ceiling unit of the liquid chamber has a thickness t. The groove has a depth h. The groove has a width s. The width of the liquid chamber in a direction sandwiched by the grooves is denoted by W. The width between the liquid chamber and the groove has a thickness L. Based on this assumption, relations of $h/t \geq 1.0$, $W/L \geq 4.7$, and $W/s \geq 0.8$ are satisfied.

Further features of the present invention will become apparent from the following description of exemplary embodiments (with reference to the attached drawings).

DESCRIPTION OF THE EMBODIMENTS

Epoxy resin has been generally used as an ejection port forming member that forms an ejection port of a liquid ejection head. In many cases, manufacture steps of a liquid ejection head using epoxy resin have a step of heating the epoxy resin to cure. It has been known that the epoxy resin has a volume contraction due to the cure shrinkage. This volume contraction causes a change in the ejection port area. The change of the ejection port area causes a variation in the droplet ejection amount, which has caused a case where a completed image outputted through the liquid ejection head includes unevenness.

In the case of Japanese Patent Laid-Open No. 2007-331245, it is possible to suppress the occurrence of the peeling at an adhesive interface between epoxy resin and a substrate supporting the epoxy resin due to the volume contraction of the epoxy resin. However, no consideration is given to a change of the opening area of the ejection port due to the volume contraction of the epoxy resin. This consequently causes a risk where the droplet ejection amount may vary to cause an image to include unevenness.

In view of the above, the present invention provides a liquid ejection head and a liquid ejection apparatus by which the variation of the droplet ejection amount can be suppressed and the occurrence of the unevenness can be suppressed.

First Embodiment

The following section will describe the first embodiment of the present invention with reference to the drawings.

Figure 1:
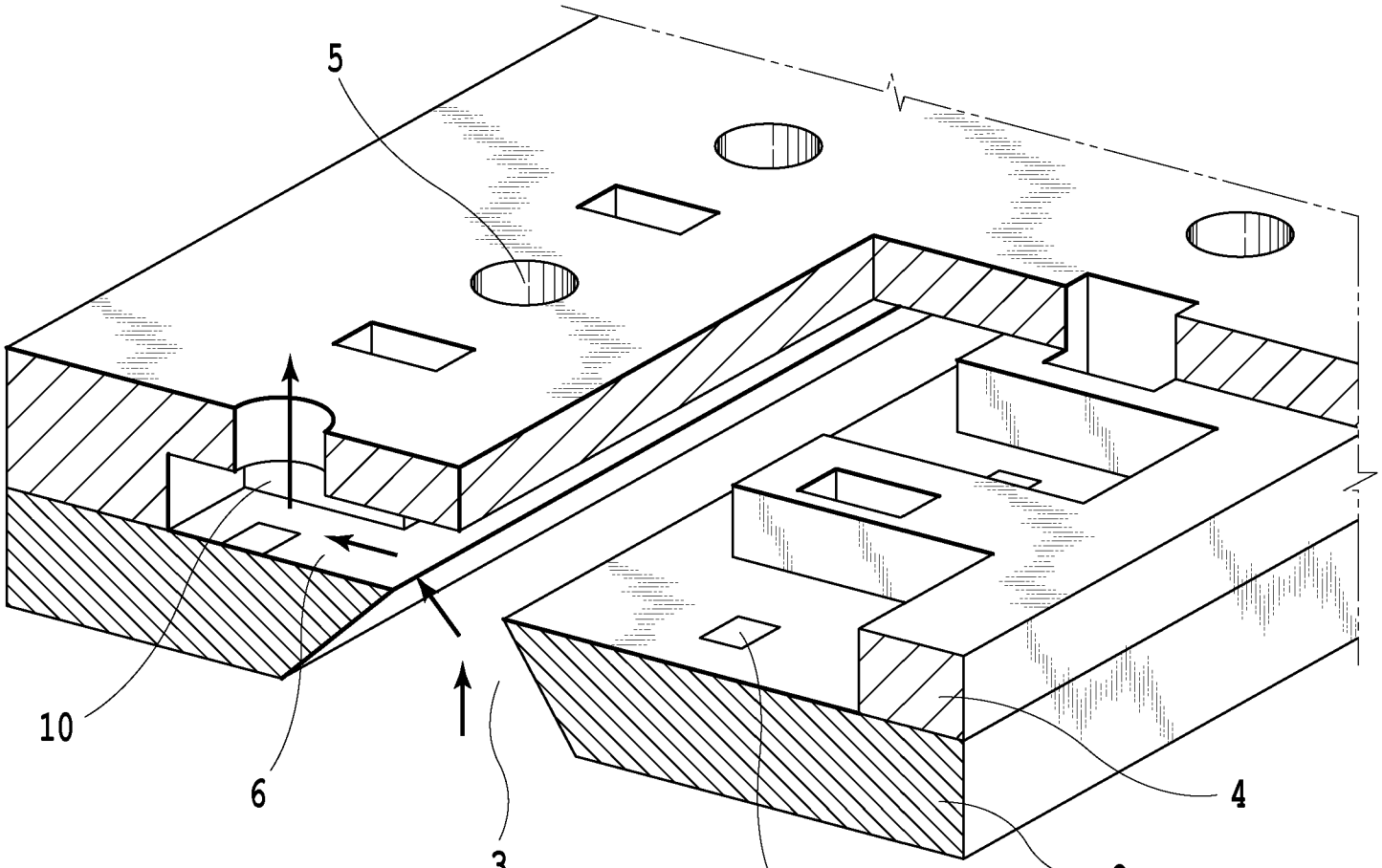
FIG. 1 is a schematic cross-sectional view illustrating ejection ports in a liquid ejection head and the vicinity thereof.

FIG. 1 is a schematic cross-sectional view illustrating the ejection port 5 in the liquid ejection head of this embodiment and the vicinity thereof. The liquid ejection head of this embodiment includes a substrate 2 in which heating resistors as energy generating elements 1 are formed with a predetermined pitch. The substrate 2 includes a supplying port 3. The substrate 2 has thereon an ejection port forming member 4.

The ejection port forming member 4 forms at least two or more ejection ports 5 opened at the upper side of the energy generating element 1 and an individual supply path 6 communicating with a liquid chamber 10 connected to the supplying port 3 and the respective ejection ports 5. The liquid chamber 10 is provided so as to communicate with the ejection ports so as to correspond to the ejection ports 5. In the drawing, the arrows represent a direction along which ejected liquid flows. The liquid is ejected through the ejection port 5.

Figure 2A:
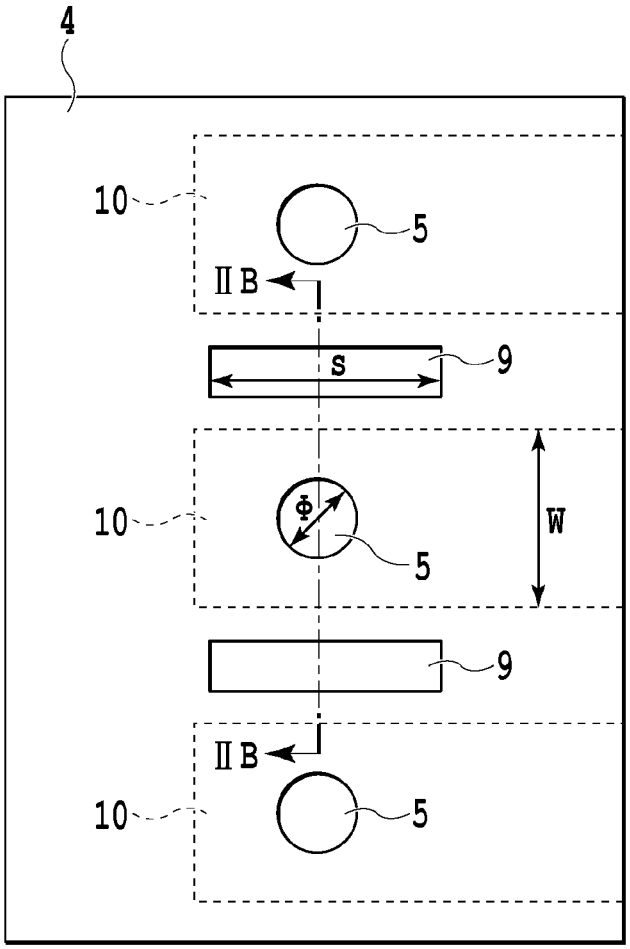
FIG. 2A illustrates the liquid ejection head.
Figure 2B:
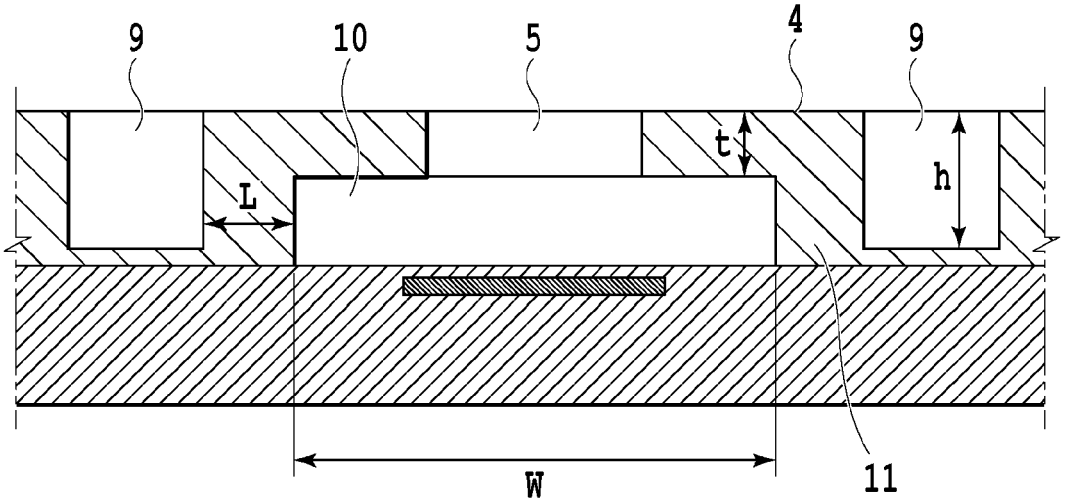
FIG. 2B illustrates the liquid ejection head.

FIG. 2A and FIG. 2B illustrate the liquid ejection head of this embodiment. FIG. 2A is a front view. FIG. 2B is a cross-sectional view at IIB-IIB of FIG. 2A. The following section will describe a characteristic configuration of the liquid ejection head of this embodiment with reference to the drawings.

In the liquid ejection head of this embodiment, a groove 9 is provided in the ejection port forming member 4 at a position between neighboring ejection ports 5 and between neighboring liquid chambers 10 between which the energy generated by the energy generating element 1 acts upon liquid. The grooves 9 are formed in the same column as the ejection port array in which the ejection ports 5 are arranged. The grooves 9 are formed so as to sandwich the ejection port 5 and the liquid chamber 10. Furthermore, the grooves 9 are symmetrically provided around the ejection port 5 as a center.

In this embodiment, epoxy resin is used as material of the ejection port forming member 4. When the ejection port forming member 4 includes epoxy resin, the epoxy resin is frequently cured due to heating. It has been known that epoxy resin has a volume contraction due to the cure shrinkage. This volume contraction may cause a change in the opening area of the ejection port 5. However, this phenomenon is not limited to epoxy resin and also may occur in the use of other resins.

Figure 3A:
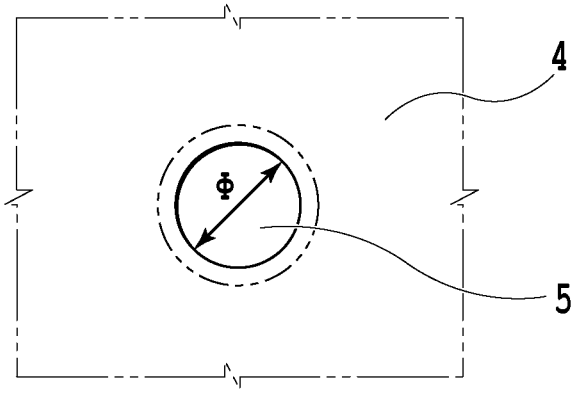
FIG. 3A illustrates an ejection port deformed due to the volume contraction of epoxy resin.
Figure 3B:
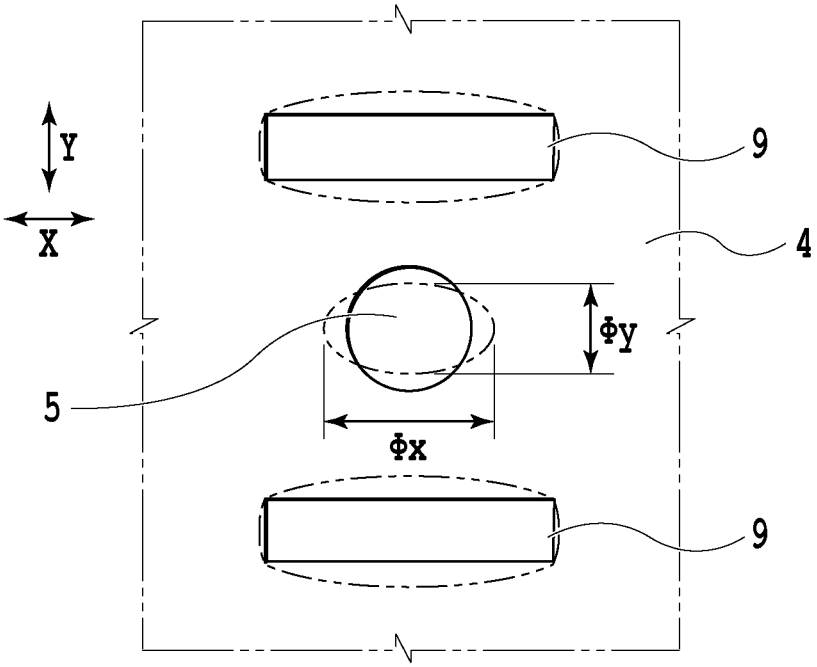
FIG. 3B illustrates an ejection port deformed due to the volume contraction of epoxy resin.
Figure 4:
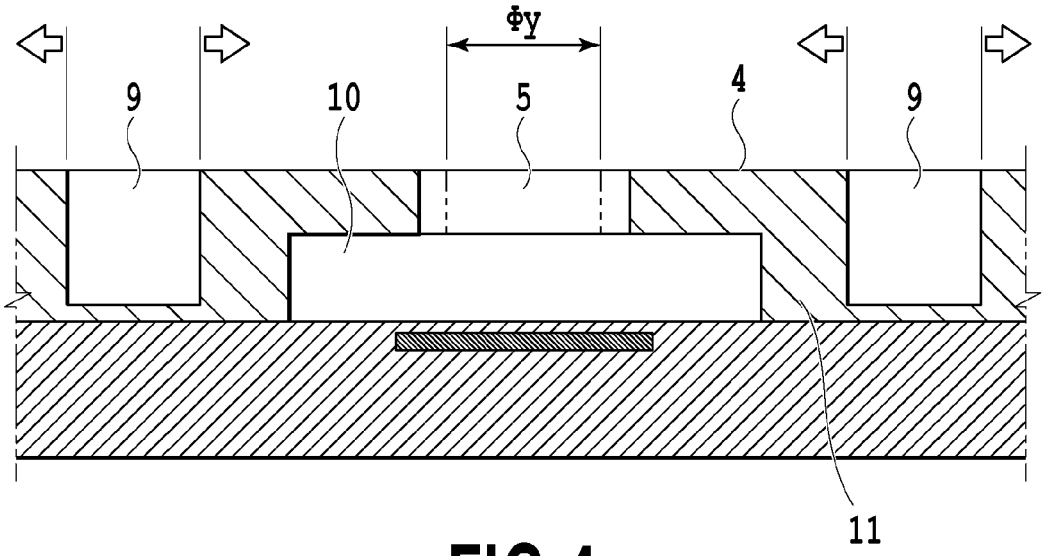
FIG. 4 is a cross-sectional view illustrating a liquid ejection head.

FIG. 3A and FIG. 3B illustrate an ejection port deformed due to the volume contraction of epoxy resin. FIG. 4 is a cross-sectional view illustrating the liquid ejection head. In FIG. 3A and FIG. 3B, the solid line shows the ejection port after the deformation while the dotted line shows the ejection port prior to the deformation. Conventionally, when the ejection port forming member 4 deforms and shrinks as shown in FIG. 3A, the ejection port 5 has an elongated diameter, resulting in a tendency where the ejection port is expanded compared to the size prior to the deformation. The deformation amount in the deformation as described above depends on a temperature. Thus, a temperature distribution has caused a variation in the opening area of the ejection port.

To solve this, in this embodiment, the groove 9 is provided as shown in FIG. 3B to thereby suppress the variation in the opening area of the ejection port due to the temperature distribution. In this embodiment, the grooves 9 are arranged as shown in FIG. 3B in the same column as the ejection port array so that the grooves 9 are arranged at both sides of each ejection port 5.

It is assumed that a direction along which the ejection port 5 and the groove 9 are arranged is a direction Y while a direction orthogonal to the direction Y is a direction X. In this case, the epoxy resin amount around the ejection port in the direction Y to the ejection port 5 is smaller than the epoxy resin amount in the direction X to the ejection port 5. Thus, the deformation amount caused when the ejection port forming member 4 deforms and shrinks is different depending on the direction Y and the direction X to the ejection port 5. Specifically, the direction X to the ejection port 5 requires a large amount of epoxy resin. Thus, the deformation amount in the shrinkage deformation is larger than the deformation amount in the direction Y.

The existence of the groove 9 allows the ejection port forming member 4 to have a region (separation wall 11) providing a free deformation in the vicinity of the liquid chamber 10. When the stress due to the shrinkage deformation of the epoxy resin is sufficiently high, the separation wall 11 can be deflected.

As a result, as shown in FIG. 3B, the ejection port 5 is deformed to have an ellipsoidal shape by having a diameter Φx in the direction X and a diameter Φy in the direction Y (Φx>Φy). The diameters Φx and Φy showing the diameter of the ejection port 5 after the deformation have a relation of Φx>Φ>Φy with regards to the diameter of the ejection port 5 prior to the deformation. Specifically, the diameter is larger than the original one in the direction X while the diameter is smaller than the original one in the direction Y. As described above, the epoxy resin volume is different depending on the direction X and the direction Y at the periphery of the ejection port, thus causing the shrinkage deformation having a different contraction rate.

Furthermore, by allowing the separation wall 11 to be deflected during the deformation, with regard to the diameter of the ejection port prior to the deformation, the deformation is caused based on a relation between the deformation to reduce the diameter in the direction X and the direction Y and the deformation to increase the diameter in the direction X and the direction Y. As a result, the ejection port 5 after the deformation has an ellipsoidal shape and has the opening area not significantly different from the opening area of the ejection port 5 prior to the deformation. As described above, this embodiment can more effectively suppress the variation of the opening area of the ejection port 5 due to the volume contraction of the epoxy resin than in the case of a conventional example.

In order to provide the deformation as in this embodiment, it is important to sufficiently deflect the separation wall 11. It is assumed that the groove 9 has a depth h, the groove 9 has a width s, the width of the liquid chamber 10 in a direction sandwiched between the grooves 9 is W, and the width between the liquid chamber 10 and the groove 9 (separation wall 11) has a thickness L (see FIG. 2B). According to the examination by the present invention, it was clarified that the following relations must be satisfied in order to sufficiently deflect the separation wall 11.

$$h/t \geq 1.0$$

$$W/s \geq 0.8$$

$$W/L \geq 4.7$$

The ejection port 5 has a diameter shown by Φ.

The bottom part of the groove 9 is preferably formed at a position closer to the substrate than at the position of the substrate-side face of the ceiling member constituting the liquid chamber 10. By reducing the thickness of the bottom part in the manner as described above, the separation wall 11 can be deflected in an easier manner. Furthermore, by sufficiently increasing the groove width s to the ceiling width W, the separation wall 11 can be easily deflected to the stress to cause the ceiling to contract. Furthermore, by sufficiently reducing the width L of the separation wall to the ceiling width W, the separation wall 11 can be easily deflected to the stress to cause the ceiling member to contract.

By providing the grooves 9 in the same column as the column in which the ejection port 5 is arranged (i.e., by providing the grooves 9 in the ejection port array to sandwich the ejection port 5), the deflection of the separation wall 11 is effectively transmitted as the deformation of the ejection port 5. By providing the grooves 9 in a symmetric manner to the ejection port 5, the symmetricity of the ejection port after the deformation can be maintained in a predetermined direction (groove arrangement direction). By causing the deflection of the separation wall 11 and the volume contraction to occur, the variation of the ejection port opening area after the deformation can be suppressed, thus suppressing the variation of the amount of ejected droplets.

Figure 5:
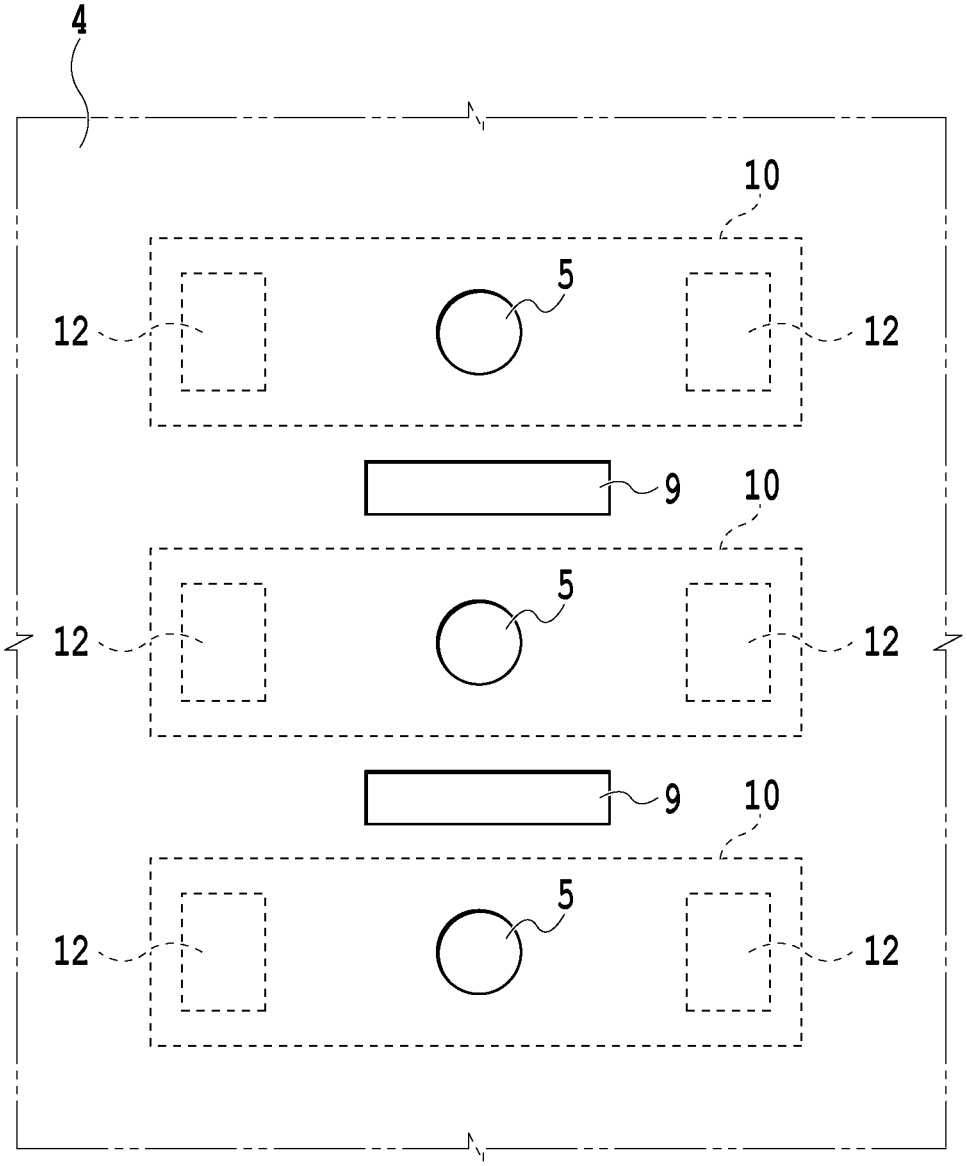
FIG. 5 illustrates ejection ports and grooves with supplying ports symmetrically provided to sandwich an ejection port.

FIG. 5 illustrates the ejection ports and the grooves when the supplying ports are symmetrically provided to sandwich the ejection port. A configuration may be used as shown in FIG. 5 in which the supplying ports 12 are provided to sandwich the ejection port 5. By the configuration in which the supplying ports 12 are provided to sandwich the ejection port 5, the ejection performance during the droplet ejection also can be improved. Furthermore, in the configuration in which the supplying ports are provided to sandwich the ejection port, droplets are supplied to the ejection port 5 both from the left and right sides. Thus, the liquid supply performance is also improved.

Figure 6A:
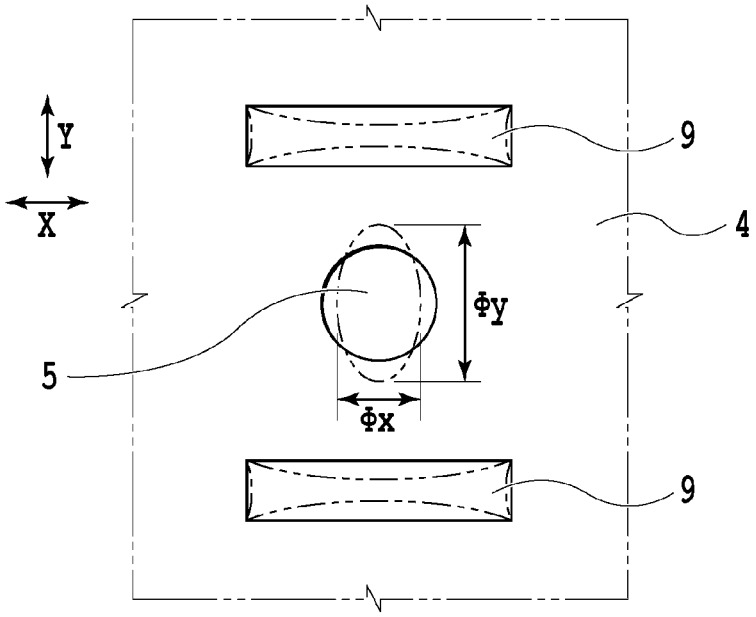
FIG. 6A illustrates an ejection port and the periphery thereof when the epoxy resin is expanded and deformed.
Figure 6B:
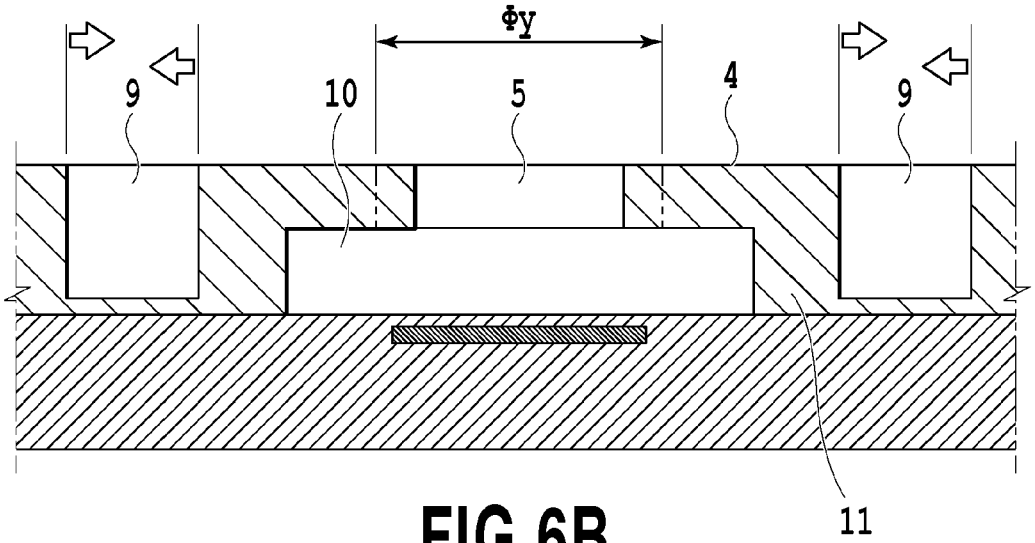
FIG. 6B illustrates an ejection port and the periphery thereof when the epoxy resin is expanded and deformed.

FIG. 6A and FIG. 6B illustrate an ejection port and the periphery thereof when the epoxy resin is expanded and deformed. Although the above description has described a case where the epoxy resin shrinks and is deformed, a similar effect is also obtained even in the case where the epoxy resin is expanded and deformed. Specifically, as shown in FIG. 6A and FIG. 6B, the diameter Φy can be deformed in an expanding direction and the diameter Φx can be deformed in a shrinking direction by providing the directions of their diameter change in opposite negative and positive directions. Even when the expansion and deformation are caused, the variation of the opening area of the ejection port can be more effectively suppressed when compared with the case of the conventional example.

Furthermore, in this embodiment, the grooves 9 are formed to sandwich the ejection port 5. However, the invention is not limited to this. Specifically, any configuration may be used so long as a space is provided so that the ejection port is sandwiched with a reduced resin volume.

In this manner, grooves having a predetermined width and a predetermined depth are formed to sandwich the ejection port in a manner to satisfy the above relations (i.e., $h/t \geq 1.0$, $W/L \geq 4.7$, and $W/s \geq 0.8$). This can consequently realize a liquid ejection head and a liquid ejection apparatus by which the variation of the droplet ejection amount can be suppressed and the occurrence of unevenness can be suppressed.

Second Embodiment

The following section will describe the second embodiment of the present invention with reference to the drawings. This embodiment has a basic configuration similar to that of the first embodiment. Thus, the following section will describe a characteristic configuration only.

Figure 7:
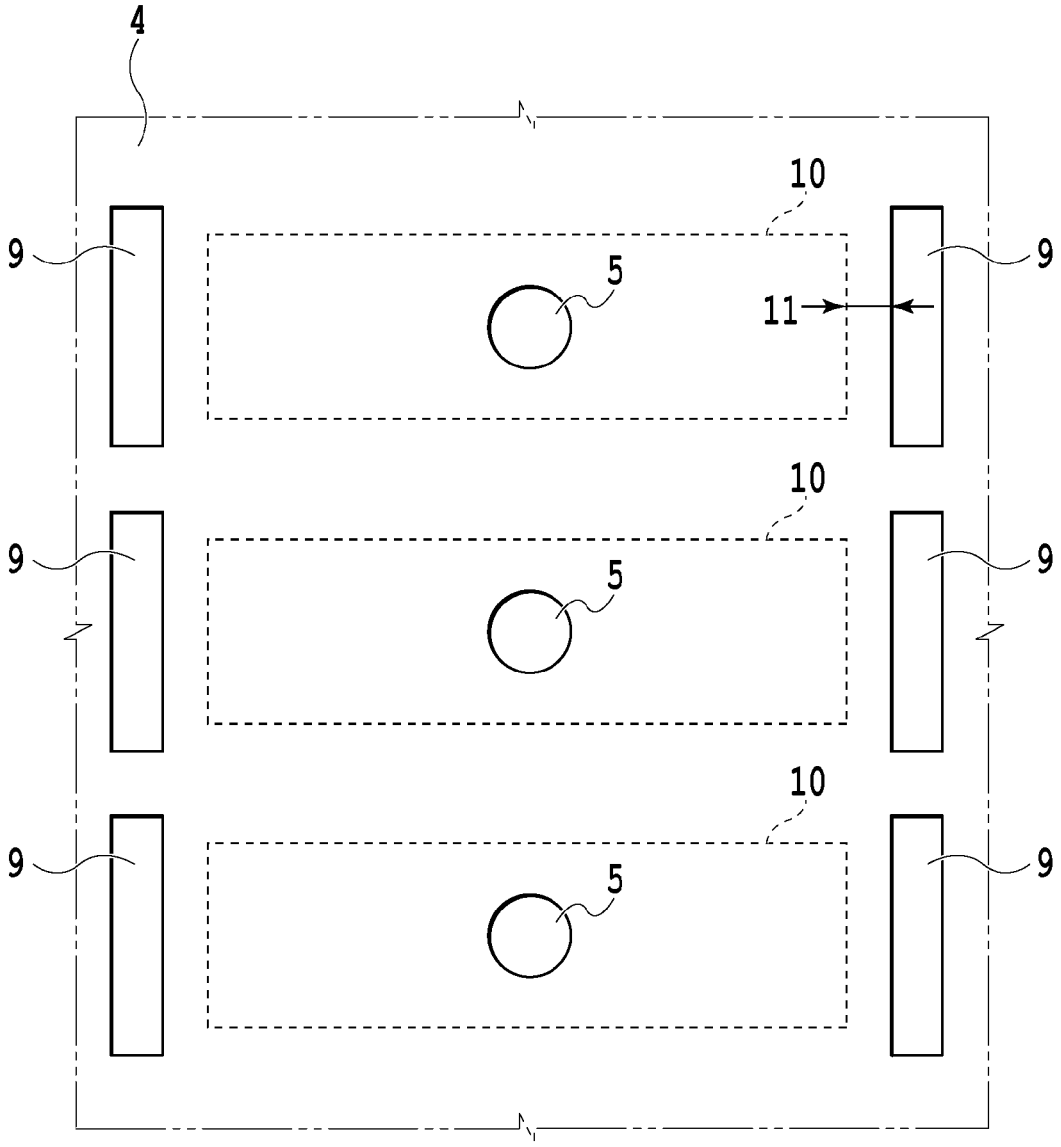
FIG. 7 illustrates an ejection port 5 in the liquid ejection head and the periphery thereof.

FIG. 7 illustrates the ejection port 5 and the periphery thereof in the liquid ejection head of this embodiment. In the first embodiment, a configuration was described in which an ejection port array includes therein the groove 9. However, the liquid ejection head of this embodiment is configured so that a column different from an ejection port array is formed along the ejection port array and the grooves 9 are provided to sandwich the ejection port 5. When the grooves 9 are arranged in the ejection port array as in the first embodiment, ejection ports arranged with a high density inevitably cause a reduced thickness of the width between the ejection ports. This consequently suppresses the grooves 9 from being formed while securing the thickness of the separation wall 11 (i.e., an area having a close contact with the substrate). To solve this, a configuration as in this embodiment can be used in which grooves are provided not in the same column as that of an ejection port array and are provided so as to sandwich the ejection port. This configuration can independently and optimally set the thickness of the separation wall 11 regardless of the density of ejection ports.

An angle formed by the ejection port array and the groove column may be set within a range within which no adverse effect on the layout is caused. Such a range is preferably 0° to 2°.

In this embodiment, the ejection port after the deformation also has an ellipsoidal shape. However, the ejection port in this embodiment has an ellipsoidal shape in which the long axis and the short axis are inverted when compared with the shape of the first embodiment. This embodiment is similar to the first embodiment in that the deflection of the separation wall 11 and the volume contraction can suppress the variation of the ejection port opening area after the deformation, thus suppressing the variation of the amount of ejected droplets.

Third Embodiment

The following section will describe the third embodiment of the present invention with reference to the drawings. This embodiment has a basic configuration similar to that of the first embodiment. Thus, the following section will describe a characteristic configuration only.

Figure 8A:
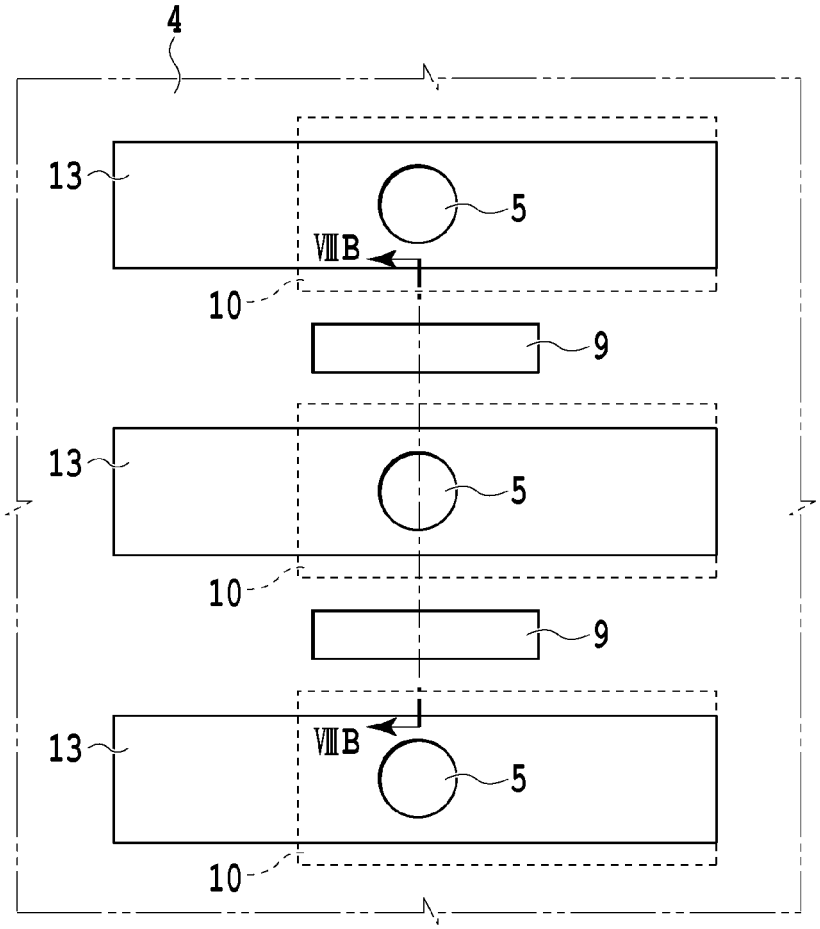
FIG. 8A illustrates a liquid ejection head.
Figure 8B:
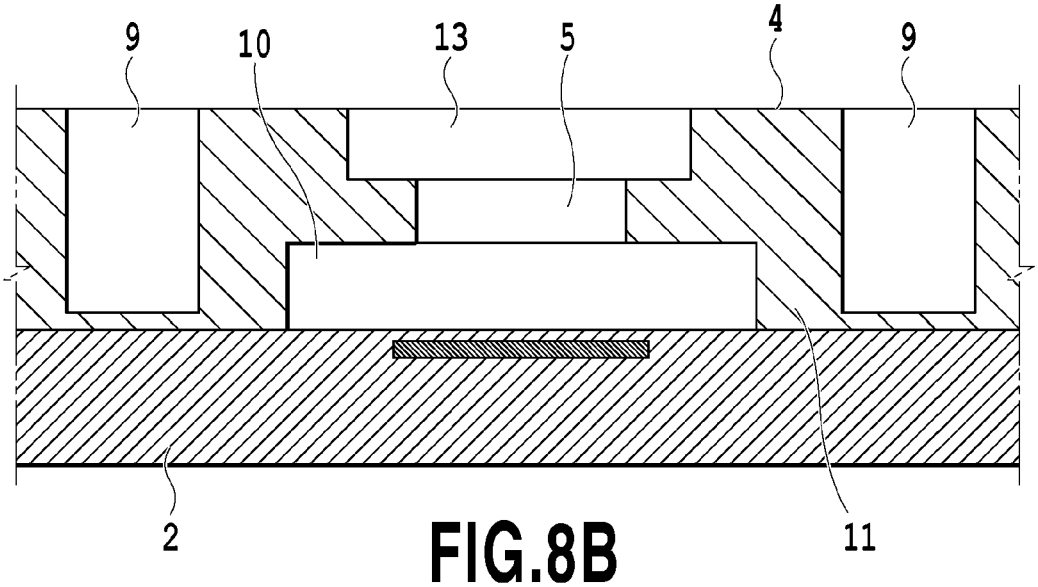
FIG. 8B illustrates the liquid ejection head.

FIG. 8A and FIG. 8B illustrate the liquid ejection head of this embodiment. FIG. 8A is a front view. FIG. 8B is a cross-sectional view at VIIIB-VIIIB of FIG. 8A. The liquid ejection head of this embodiment is configured so that the ceiling member including the ejection port 5 has a depression region 13 obtained by forming a depression in the ejection port forming member at an opposite side of the liquid chamber 10 with regard to the ejection port 5. The ejection port 5 exists in the depression region 13. The depression region 13 has a step obtained by forming a depression substantially parallel to the groove 9. The depression region 13 has a width smaller than the width of the ceiling member.

Figure 9A:
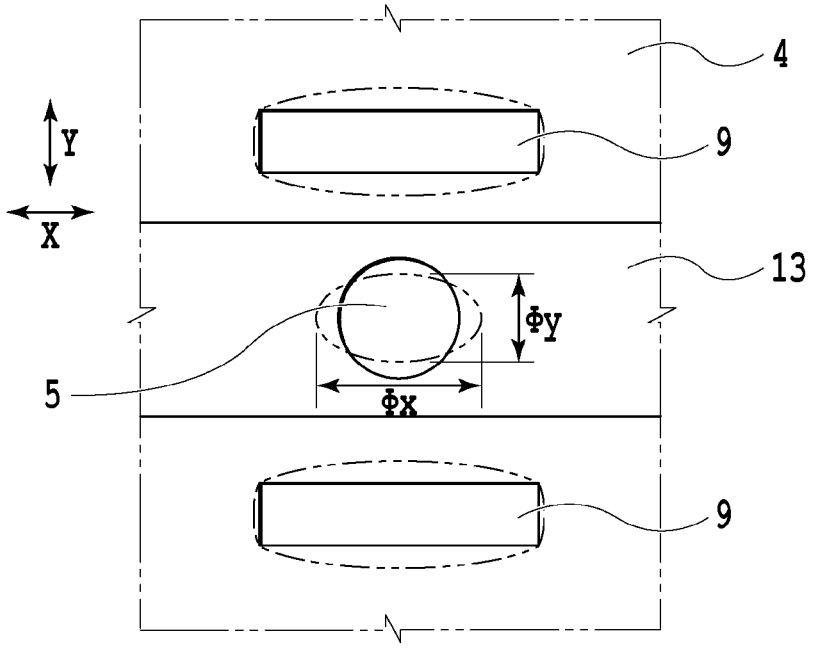
FIG. 9A illustrates the periphery of the ejection port in the liquid ejection head.
Figure 9B:
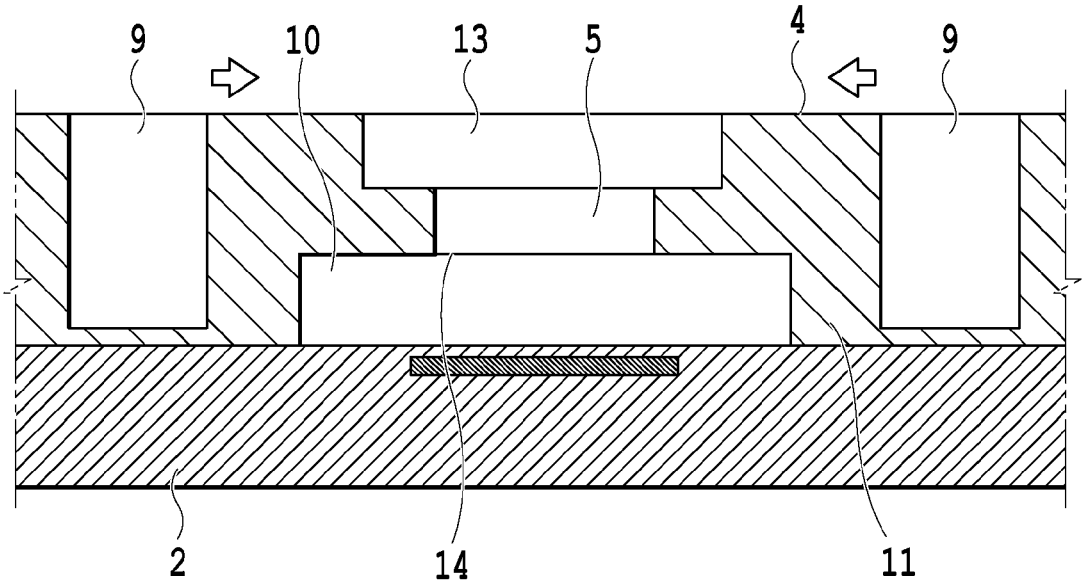
FIG. 9B illustrates the periphery of the ejection port in the liquid ejection head.

FIG. 9A and FIG. 9B illustrate the periphery of the ejection port in the liquid ejection head of this embodiment. FIG. 9A is a front view. FIG. 9B is a cross-sectional view. In this embodiment, the following section will describe the deformation when the volume contraction occurs. As in the first embodiment, the existence of the groove 9 causes the diameter of the ejection port in the direction Y to shrink and deform to have diameter Φy and the diameter in the direction X expands and deforms to have diameter Φx (Φx>Φy). The reason why such a change is caused is that, as shown by the arrows in the schematic cross-sectional view of FIG. 9B, the separation wall 11 deflects toward the liquid chamber 10 and the epoxy resin itself has a volume contraction.

In this embodiment, the depression region 13 is formed to have a width smaller than that of the ceiling member. The existence of such a depression region 13 causes a stress to lift the ceiling member toward the surface side (the upper side in the drawing). In the first embodiment, when the separation wall 11 deflects, the neighborhood of the ejection port changes in a direction along which the entirety falls to the substrate side (i.e., the neighborhood of the ejection port changes so that the surface of the substrate 2 moves closer to the surface of the ejection port 5 to reduce a distance therebetween). When this change increases, the droplet formation accuracy may decline or the droplet volume may easily change. This may consequently cause an influence on the resultant outputted image.

The configuration of this embodiment has an effect that the deflection of the separation wall 11 is used to reduce the action to lower the ejection port neighborhood 14. This can consequently reduce the change of the ejection port area while maintaining a fixed distance between the ejection port 5 and the surface of the substrate.

Figure 10:
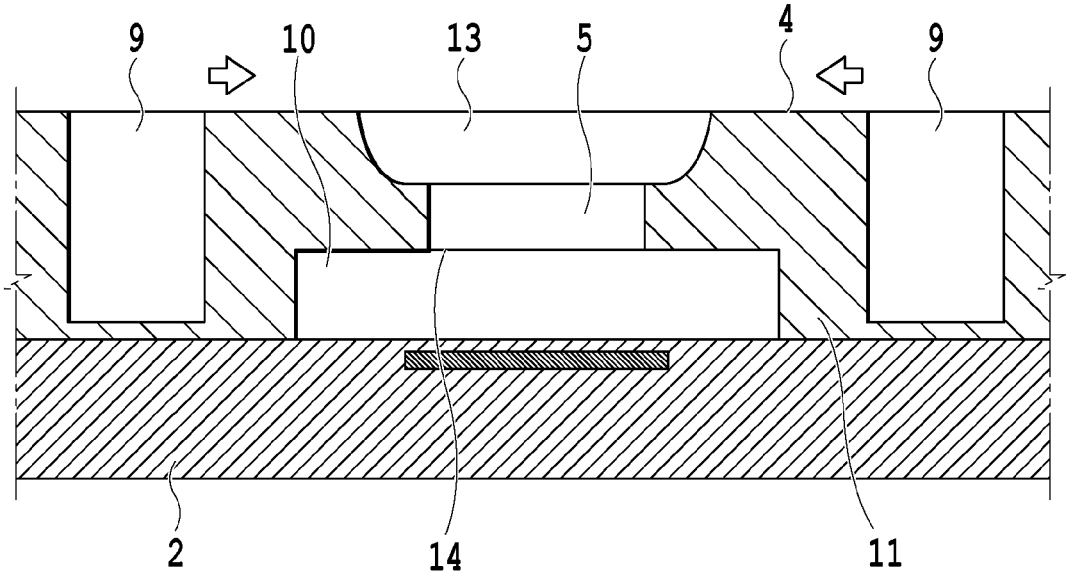
FIG. 10 illustrates a modification example.

FIG. 10 illustrates the modification example of this embodiment. When the depression region 13 of the ceiling member is formed by a mortar-like curved surface as in FIG. 10, the concentration of the stress to the step can be reduced and thus the breakage such as a member crack can be suppressed, thus further improving the reliability.

Fourth Embodiment

The following section will describe the fourth embodiment of the present invention with reference the drawings. This embodiment has a basic configuration similar to that of the first embodiment. Thus, the following section will describe a characteristic configuration only.

Figure 11:
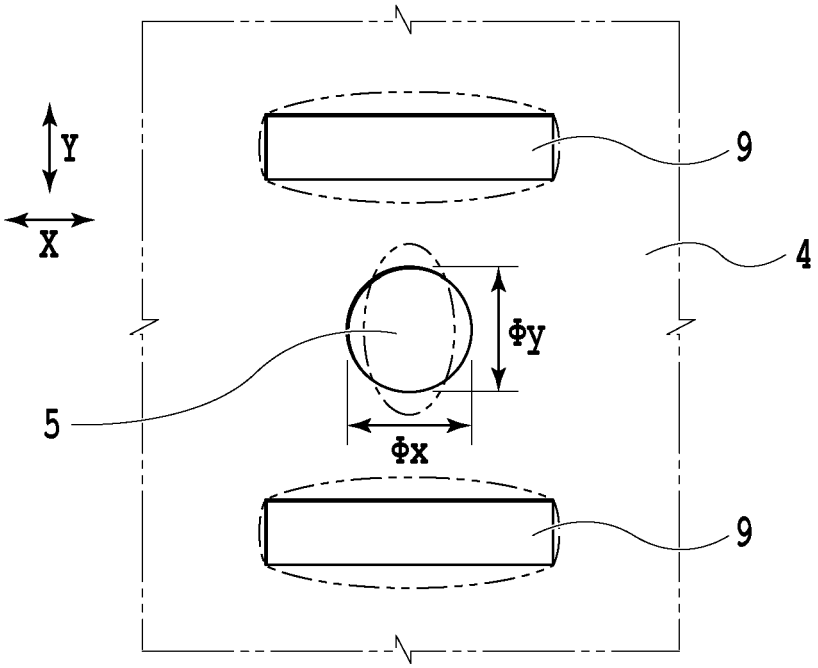
FIG. 11 illustrates the periphery of the ejection port of the liquid ejection head.

FIG. 11 illustrates the periphery of the ejection port of the liquid ejection head in this embodiment. In the case of a liquid ejection head using epoxy resin as the ejection port forming member 4, such a manufacture method is generally used that has a step to use epoxy resin as negative photosensitive resin to form an ejection port by photolithography to subsequently cure the epoxy resin in a heating step.

manufactured at the completion, thus improving the stability of the droplet formation and preventing the deterioration of the resultant image outputted through the liquid ejection head.

EXAMPLE

A plurality types of liquid ejection heads were actually manufactured to actually perform an output, thereby confirming the existence or nonexistence of the unevenness occurring in an output image. The liquid ejection heads were manufactured based on the method of the first embodiment. The liquid ejection heads were manufactured using ejection port forming members of epoxy resin (EHPE3150, made by Daicel). As a final step, in order to promote the curing reaction of the epoxy resin, a burning process was performed in an oven at 200 degrees C. for 1 hour. Table 1 shows the sizes of the respective parts of the respective liquid ejection heads, the changes of the ejection port areas, the size ratio of the respective parts, and the determination result.

TABLE 1

| | ϕ [μm] | s [μm] | W [μm] | L [μm] | t [μm] | h [μm] | Δϕ [μm] | Δϕ [μm] | ΔS | W/s | W/L | h/t |
|---|---|---|---|---|---|---|---|---|---|---|---|---|
| Example 1 | 10.0 | 40.0 | 40.0 | 5.0 | 5.0 | 5.0 | 0.8 | −0.3 | 104.00% | 1.0 | 8.0 | 1.0 |
| Example 2 | 10.0 | 40.0 | 40.0 | 5.0 | 5.0 | 6.0 | 0.8 | −0.6 | 101.50% | 1.0 | 8.0 | 1.2 |
| Example 3 | 10.0 | 40.0 | 40.0 | 5.0 | 5.0 | 8.0 | 0.8 | −0.8 | 99.40% | 1.0 | 8.0 | 1.6 |
| Example 4 | 10.0 | 40.0 | 40.0 | 5.0 | 5.0 | 10.0 | 0.8 | −1.0 | 97.20% | 1.0 | 8.0 | 2.0 |
| Example 5 | 10.0 | 30.0 | 40.0 | 5.0 | 5.0 | 10.0 | 1.0 | −0.4 | 105.60% | 0.8 | 8.0 | 2.0 |
| Example 6 | 20.0 | 30.0 | 40.0 | 5.0 | 5.0 | 10.0 | 1.2 | −0.2 | 104.90% | 0.8 | 8.0 | 2.0 |
| Example 7 | 16.0 | 40.0 | 40.0 | 5.0 | 5.0 | 10.0 | 1.0 | −1.4 | 97.00% | 1.0 | 8.0 | 2.0 |
| Example 8 | 21.2 | 40.0 | 47.0 | 10.0 | 6.0 | 12.0 | 1.5 | −0.2 | 106.00% | 0.9 | 4.7 | 2.0 |
| Example 9 | 21.2 | 84.0 | 47.0 | 10.0 | 6.0 | 12.0 | 1.0 | −0.6 | 102.00% | 1.8 | 4.7 | 2.0 |
| Comparison Example 1 | 10.0 | 0.0 | 40.0 | 5.0 | 5.0 | 0.0 | 0.8 | 1.0 | 118.80% | 0.0 | 8.0 | 0.0 |
| Comparison Example 2 | 10.0 | 40.0 | 40.0 | 5.0 | 5.0 | 2.0 | 0.8 | 0.6 | 114.50% | 1.0 | 8.0 | 0.4 |
| Comparison Example 3 | 10.0 | 40.0 | 40.0 | 5.0 | 5.0 | 4.0 | 0.8 | 0.0 | 108.00% | 1.0 | 8.0 | 0.8 |
| Comparison Example 4 | 10.0 | 5.0 | 40.0 | 5.0 | 5.0 | 10.0 | 0.8 | 0.8 | 116.60% | 0.1 | 8.0 | 2.0 |
| Comparison Example 5 | 10.0 | 10.0 | 40.0 | 5.0 | 5.0 | 10.0 | 1.0 | 0.6 | 116.60% | 0.3 | 8.0 | 2.0 |
| Comparison Example 6 | 10.0 | 20.0 | 40.0 | 5.0 | 5.0 | 10.0 | 1.0 | 0.2 | 112.20% | 0.5 | 8.0 | 2.0 |
| Comparison Example 7 | 20.0 | 5.0 | 40.0 | 5.0 | 5.0 | 10.0 | 1.2 | 1.6 | 114.50% | 0.1 | 8.0 | 2.0 |
| Comparison Example 8 | 20.0 | 10.0 | 40.0 | 5.0 | 5.0 | 10.0 | 1.2 | 1.4 | 113.40% | 0.3 | 8.0 | 2.0 |
| Comparison Example 9 | 20.0 | 20.0 | 40.0 | 5.0 | 5.0 | 10.0 | 1.2 | 0.6 | 109.20% | 0.5 | 8.0 | 2.0 |
| Comparison Example 10 | 16.0 | 40.0 | 40.0 | 10.0 | 5.0 | 10.0 | 1.0 | 0.0 | 106.30% | 1.0 | 4.0 | 2.0 |
| Comparison Example 11 | 16.0 | 40.0 | 40.0 | 20.0 | 5.0 | 10.0 | 1.2 | 1.0 | 114.20% | 1.0 | 2.0 | 2.0 |
| Comparison Example 12 | 16.0 | 40.0 | 40.0 | 30.0 | 5.0 | 10.0 | 1.2 | 1.4 | 116.90% | 1.0 | 1.3 | 2.0 |
| Comparison Example 13 | 21.2 | 0.0 | 47.0 | 10.0 | 6.0 | 0.0 | 1.5 | 1.0 | 112.00% | 0.0 | 4.7 | 0.0 |
| Comparison Example 14 | 21.2 | 10.0 | 47.0 | 10.0 | 6.0 | 12.0 | 1.5 | 0.8 | 110.00% | 0.2 | 4.7 | 2.0 |

In the manufacture method as described above, the ejection port is preferably formed to have an ellipsoidal shape so that the long axis direction is substantially parallel to the direction along which the grooves are opposed. According to this configuration, the contraction and deformation of the epoxy resin by the heating step can be used to deform the ellipsoidal ejection port shown by the dotted line of FIG. 11 to a circular ejection port. Thus, a liquid ejection head having an ejection port having a high roundness can be The respective examples satisfy the relations of $h/t \geq 1.0$, $W/L \geq 4.7$, and $W/s \geq 0.8$. As a result, the ejection port area change ΔS could be suppressed to a change of ±6% or less. Furthermore, the yield ratios could be improved when compared with Comparison Examples, thus suppressing the unevenness in output images from occurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-159000 filed Aug. 11, 2015, which is hereby incorporated by reference herein in its entirety.

What is claimed is:

1. A liquid ejection head for ejecting liquid through at least two ejection ports formed in an ejection port forming member, a liquid chamber communicating with the ejection ports being formed so as to correspond to the ejection ports, wherein:

the ejection port forming member has grooves so as to sandwich the ejection ports and the liquid chamber, a single one of the ejection ports being sandwiched between a pair of the grooves, when assuming that a part of the ejection port forming member forming a ceiling unit of the liquid chamber has a thickness t, the groove has a depth h and a width s, a width of the liquid chamber in a direction sandwiched by the grooves is denoted by W, and a width between the liquid chamber and one of the grooves has a thickness L, the following relations are satisfied:

$h/t \geq 1.0$, $W/L \geq 4.7$, and $W/s \geq 0.8$.

2. The liquid ejection head according to claim 1, wherein the grooves are formed in an ejection port array formed by the ejection ports.

3. The liquid ejection head according to claim 1, wherein the grooves are formed along an ejection port array formed by the ejection ports so as to form another column different from the ejection port array.

4. The liquid ejection head according to claim 1, wherein the grooves are symmetrically formed around respective ejection ports as a center.

5. The liquid ejection head according to claim 1, comprising:

a supplying port for supplying liquid to the liquid chamber, and a supply path connecting the supplying port to the liquid chamber.

6. The liquid ejection head according to claim 1, wherein a part of the ejection port forming member adjacent to the ejection ports at an opposite side of the liquid chamber has a depression region obtained by forming a depression in the ejection port forming member.

7. The liquid ejection head according to claim 6, wherein the depression region has a mortar-like shape.

8. The liquid ejection head according to claim 1, wherein the ejection port forming member comprises epoxy resin.

9. The liquid ejection head according to claim 1, wherein the grooves do not penetrate the ejection port forming member.

10. A liquid ejection apparatus having a liquid ejection head for ejecting liquid through at least two ejection ports formed in an ejection port forming member, a liquid chamber communicating with the ejection ports being formed so as to correspond to the ejection ports, wherein:

the ejection port forming member has grooves so as to sandwich the ejection ports and the liquid chamber, a single one of the ejection ports being sandwiched between a pair of the grooves, when assuming that a part of the ejection port forming member forming a ceiling unit of the liquid chamber has a thickness t, the groove has a depth h and a width s, a width of the liquid chamber in a direction sandwiched by the grooves is denoted by W, and a width between the liquid chamber and one of the grooves has a thickness L, the following relations are satisfied:

$h/t \geq 1.0$, $W/L \geq 4.7$, and $W/s \geq 0.8$.

11. The liquid ejection apparatus according to claim 10, wherein the grooves are formed in an ejection port array formed by the ejection ports.

12. The liquid ejection apparatus according to claim 10, wherein the grooves are formed along an ejection port array formed by the ejection ports so as to form another column different from the ejection port array.

13. The liquid ejection apparatus according to claim 10, wherein the grooves are symmetrically formed around respective ejection ports as a center.

14. The liquid ejection apparatus according to claim 10, wherein the liquid ejection head includes a supplying port for supplying liquid to the liquid chamber and a supply path connecting the supplying port to the liquid chamber.

15. The liquid ejection apparatus according to claim 10, wherein the liquid ejection head is configured so that a part of the ejection port forming member adjacent to the ejection ports at an opposite side of the liquid chamber has a depression region obtained by forming a depression in the ejection port forming member.

16. The liquid ejection apparatus according to claim 15, wherein the depression region has a mortar-like shape.

17. The liquid ejection apparatus according to claim 10, wherein the ejection port forming member comprises epoxy resin.

18. The liquid ejection apparatus according to claim 10, wherein the grooves do not penetrate the ejection port forming member.

* * * * *